United States Patent [19]

Hiszpanski

[11] 4,082,471

[45] Apr. 4, 1978

[54] UNIVERSAL HYDRAULIC IMPACT TOOL

[75] Inventor: Jan A. Hiszpanski, Upland, Calif.

[73] Assignee: Imperial-Eastman Corporation, Chicago, Ill.

[21] Appl. No.: 646,151

[22] Filed: Jan. 2, 1976

[51] Int. Cl.[2] ..... E01C 19/35

[52] U.S. Cl. ..... 404/133; 91/231; 173/139; 173/134

[58] Field of Search ..... 404/133; 173/134, 139; 91/218, 225, 231, 319

[56] References Cited

U.S. PATENT DOCUMENTS

| | | | |
|---|---|---|---|
| 504,802 | 9/1893 | Drawbaugh | 173/134 X |
| 914,602 | 3/1909 | Polzer | 173/134 X |
| 1,018,983 | 2/1912 | Padbury | 91/300 X |
| 1,075,057 | 10/1913 | Oldham | 91/300 |
| 1,144,838 | 6/1915 | Griese | 404/133 |
| 1,247,080 | 11/1917 | Christiansen | 173/134 X |
| 2,470,087 | 5/1949 | Adams | 91/225 |
| 2,748,750 | 6/1956 | Altschuler | 404/133 X |
| 3,035,548 | 5/1962 | Wittlich | 91/319 X |
| 3,411,592 | 11/1968 | Montabert | 173/134 |
| 3,412,646 | 11/1968 | Johnston | 91/300 X |
| 3,468,222 | 9/1969 | Cordes | 173/134 X |
| 3,554,085 | 1/1971 | Butterworth | 91/239 |
| 3,609,969 | 10/1971 | Gerber | 91/218 X |
| 3,713,367 | 1/1973 | Butterworth | 91/231 |
| 3,759,335 | 9/1973 | Coyne | 173/134 X |
| 3,800,662 | 4/1974 | Ackley | 91/300 X |

*Primary Examiner*—Nile C. Byers

*Attorney, Agent, or Firm*—Wegner, Stellman, McCord, Wiles & Wood

[57] ABSTRACT

A hydraulic impact tool providing improved force absorption for facilitated manipulation by an operator. In the illustrated embodiment, the tool comprises a tamper which provides substantial tamping force with minimum vibration and uncontrolled bounce. The tool utilizes a hydraulic power system for improved noise reduction and minimizaton of fatigue. The tool provides a forward stroke wherein the force is applied for a preselected time, and a retraction stroke wherein the moving elements are retracted to a preselected position. The tool is adapted for use with a wide range of load resistances.

22 Claims, 3 Drawing Figures

14
15
10
H
11
13
12
F
15a
15b
39
17
41
33
32
34
35
43
37
36
44
45
38
42
18
40
24
25
16
19
22
21
28
29
31
20
30
23
26
27
47
46
48
51
53
54

UNIVERSAL HYDRAULIC IMPACT TOOL

BACKGROUND OF THE INVENTION

1. Field of the Invention

This invention relates to reciprocating tools, and in particular to a hydraulic impact tool.

2. Description of the Prior Art

Soil tampers and compactors are utilized for compacting dirt and the like in fills such as around newly installed posts and poles. Such soil tampers utilize tamping elements which are reciprocated at relatively high frequency, such as over 1000 strokes a minute, while delivering a substantial force. Conventionally, such soil tampers have been pneumatically operated as illustrated in U.S. Pat. No. 2,748,750 of S. Altschuler, disclosing a Vibrationless Pneumatic Impact Tool. Such pneumatic tampers have a serious disadvantage of being relatively noisy and dirty in the sense that a substantial amount of dust is raised in the normal use thereof.

More recently, hydraulic soil tampers have been developed which are substantially quieter and which raise substantially less dust in the operation thereof. A problem, however, arises in connection with the use of such hydraulic impact tools in that the conventional hydraulic impact tools are relatively difficult to handle because of substantial uncontrolled bounce. Such bounce is aggravated where the material being compacted is relatively rigid and the use of such conventional tools requires substantial effort on the part of the operator to maintain the tool in the tamping disposition.

Illustrative of such tools are those disclosed in U.S. Pat. Nos. 2,470,087 (Adams); 3,314,488 (Chester-Browne et al.); 3,468,222 (Cordes et al.); 3,522,269 (Arndt); and 3,554,085 (Butterworth).

SUMMARY OF THE INVENTION

The present invention comprehends an improved hydraulic impact tool which is extremely simple and economical of construction while yet providing an improved, effectively positive control of the impacting forces with minimum bounce of the tool.

In the illustrated embodiment, the impacting tool comprises a reciprocating tamper such as for use in compacting soil. Whereas the prior art devices tend to bounce away from the area being tamped, the present tamper remains relatively effortlessly in position so that the operator may control the tamping operation with minimum effort. The tool provides the impacting operation with effectively minimized up-and-down motion so that the operator may guide the impacting operation easily while yet provide substantial impact forces.

In the use of the tool as a tamper, the facilitated control of the tool permits concentration of the tamping operation in the selected area with minimum effort.

The use of a hydraulic power system using a hydraulic piston motor effectively minimizes noise so as to minimize fatigue and hearing problems.

The impact tool of the present invention utilizes the hydraulic fluid as means for absorbing inertia energy to provide the desired reduced bounce. Illustratively, the tool may provide a $1\frac{1}{2}$ inches stroke at the rate of 1200 strokes per minute at an operating pressure of 1000 p.s.i.

The tool is relatively lightweight and may be incorporated in a tubular housing defining a grasping portion providing facilitated manipulation of the tool by the user.

The tool includes means for controlling the delivery of the hydraulic fluid to the fluid motor so as to provide a power stroke for a preselected period of time and a retraction stroke which brings the movable elements back to a preselected retracted position during each cycle. The movement of the movable elements to the end positions in both the power and retraction strokes is cushioned by application of a reverse fluid pressure to the fluid motor so that the hydraulic fluid absorbs a substantial portion of the inertia forces where necessary, thereby minimizing bounce of the tool.

The invention comprehends providing means for adjusting the period of the power stroke. More specifically, the control includes a control valve which is moved from a first position to a second position to effect reversal from the power stroke to the retraction stroke. The adjusting means defines means for adjusting the time required for the control valve to effect this change in the position of the control valve. The initiation of the positional change of the control valve is controlled by the disposition of the fluid motor. However, the fluid motor is arranged to initiate the change substantially upon initiation of the downward stroke so that the time period of the downward stroke is substantially effectively controlled solely by the control valve movement.

The impact tool may be provided without the adjustable control means where the tool is intended for use with a single preselected time power stroke.

Thus, briefly, the present invention comprehends an improved hydraulic tool for use with a hydraulic power supply utilizing a reciprocative fluid motor for reciprocating a work-engaging member and control means controlling fluid delivery to the fluid motor for driving the work-engaging member forwardly against the work for a preselected time and driving the work-engaging member away from the work to a preselected retracted position in each cycle of operation of the tool.

Thus, while the tool is extremely simple and economical of construction, it provides substantially improved functioning and long life as compared to the tools of the prior art.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3:
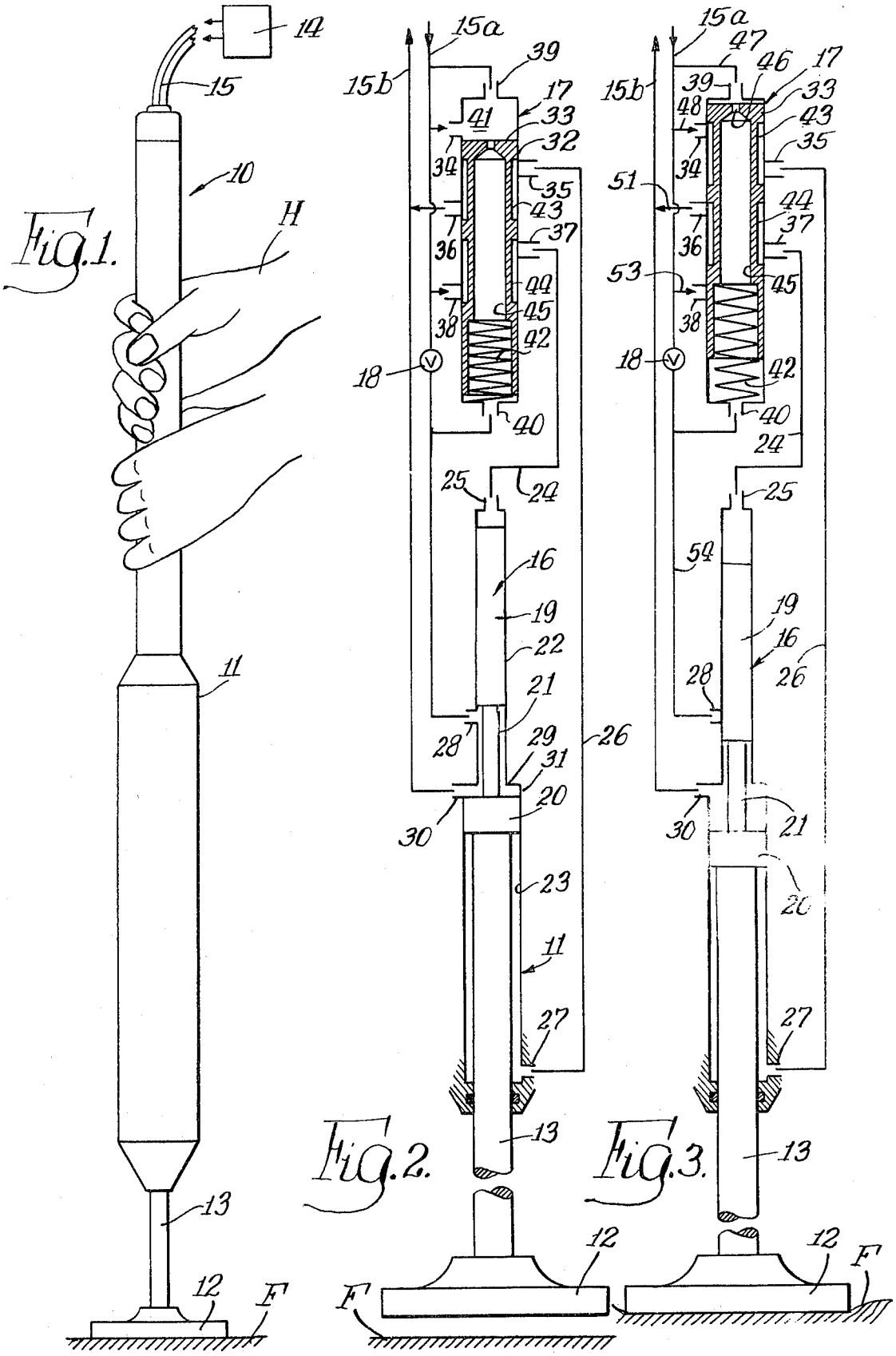
FIG. 1 is a side elevation of an impact tool embodying the invention.
FIG. 2 is a fragmentary schematic hydraulic flow diagram thereof with the tool arranged in an inner retracted disposition.
FIG. 3 is a fragmentary schematic hydraulic flow diagram thereof with the tool arranged in an outer tamping disposition.

In the exemplary embodiment of the invention as disclosed in the drawing, a hydraulic impact tool generally designated 10 is shown to comprise a housing 11 adapted to be grasped as by the user's hands H to position a tamping element 12 against fill F to be tamped. The tamping element is reciprocated by means of a tool carrier 13 which, in turn, is reciprocated within housing 11 by means of a hydraulic fluid delivered to the housing from a suitable hydraulic fluid power supply generally designated 14 through suitable flexible conduits 15.

The present invention comprehends providing in the impact tool 10 a power element generally designated 16 for driving the tool carrier 13 and control means generally designated 17 controlling the fluid delivery from the power supply 14 for reciprocating the power element 16. For improved control of the impact operation, an adjustable valve generally designated 18 may be provided for selectively adjusting the range of the stroke of the power element 16.

More specifically, power element 16 includes a first, inner piston 19 and a second, outer piston 20 herein having a larger diameter than that of first piston 19. The pistons are connected by means of a shaft 21 for reciprocation coaxially within a first small diameter cylinder 22 and a second larger diameter cylinder 23 defined by housing 11. Hydraulic fluid is delivered from power supply 14 through a supply conduit **15*a* and returned to the power supply 14 through a return conduit 15*b*. The fluid is delivered to and returned from cylinder 22 through a first supply conduit 24 connected to a port 25 at the inner end of cylinder 22. Hydraulic fluid is delivered to and returned from cylinder 23 through a second conduit 26 connected to a port 27 at the outer end of cylinder 23. Cylinder 22 further defines a control port 28 spaced from its outer end 29 and cylinder 23 further defines an outlet port 30 adjacent its inner end 31. Outlet port 30 is connected to return conduit 15*b***.

The control means 17 defines a control valve having a housing 32 within which a spool valve member 33 is coaxially slidable for controlling fluid flow through a first, inlet port 34, a second port 35, and third, outlet port 36, a fourth port 37, a fifth, inlet port 38, a sixth, end port 39, and a seventh, opposite end port 40.

As illustrated in FIG. 2, housing 32 defines a valve chamber 41. Spool 33 is biased upwardly, as seen in FIGS. 2 and 3, by a coil spring 42. The spool defines an upper annular flow passage 43, a lower annular flow passage 44, and a through bore flow passage 45 defined at one end by an aperture 46 for controlling the rate of flow through passage 45. Port 39 is connected to the supply conduit **15*a* by a conduit 47. Port 35 is connected to port 27 of cylinder 23 by a connecting conduit 26. Port 36 is connected to return conduit 15*b* by a conduit 51. Port 37 is connected to port 25 of cylinder 22 by a connecting conduit 24. Port 38 is connected to supply conduit 15*a* by a conduit 53, and port 40 is connected to port 28 of cylinder 22 by a connecting conduit 54. Port 30 of cylinder 23 is connected to return conduit 15*b*. As desired, an adjustable valve 18 may be connected between supply conduit 15*a* and port 40 to effectively define an adjustable bypass around the valve member 33**.

The operation of hydraulic impact tool 10 is extremely simple. Assuming that the tool 12 is in the uppermost position of FIG. 2 with the power element 16 in its innermost position within cylinder portions 22 and 23, movement of the power element 16, tool carrier 13 and tool 12 downwardly is effected by the provision of pressurized hydraulic fluid from supply line **15*a* through port 25 to the inner end of cylinder 22. This is effected by the disposition of spool 33, as shown in FIG. 2, with lower flow passage 44 providing communication between ports 38 and 37 so as to provide pressurized fluid from supply conduit 15*a* through conduit 53, port 38, annular flow passage 44, port 37, conduit 24 and port 25. At the same time, hydraulic fluid is returned from cylinder 23 through port 27 thereof, conduit 26, port 35, upper annular flow passage 43, port 36 and conduit 51 to return conduit 15*b*. In this arrangement, piston 19 is spaced inwardly of port 28 so that port 40 of control valve housing 32 is connected through conduit 54, port 28, cylinder 22, and port 30 to return conduit 15*b* thereby providing low pressure on the lower end of the valve spool 33. At the same time, supply conduit 15*a* is connected through conduit 47 and port 39 to valve chamber 41 at the inner end of valve 17, thereby compressing spring 42** against the biasing action thereof.

The application of high pressure through port 25 to the inner end of the power element 16 and low pressure through port 27 to the outer end thereof now causes a downward movement of the power element from the position of FIG. 2 to the position of FIG. 3. When piston 19 moves sufficiently downwardly to close port 28, as shown in FIG. 3, port 40 is no longer connected through cylinder 22 and port 30 to the return conduit **15*b* so that pressure above and below the spool 33 will become equalized, permitting spring 42 to shift the spool upwardly, as seen in FIG. 3**.

The shifting of the spool requires a preselected time subsequent to the closing of the control port 28 as a result of the flow transfer control afforded by port 46. During this time, i.e., until the control valve switches the fluid supply connection to flow passages 43 and 44, the power element 16 continues to be urged forwardly by the hydraulic fluid pressure applied through port 25. Upon completion of the shifting of the control valve, and while the power element may be continuing to move forwardly in the power stroke due to its inertia, application of high pressure to the piston housing port 25 is terminated.

Thus, the timed shifting of the spool 33 effectively causes control means 17 to define means for causing the driving of the work engaging member 12 forwardly against the work F for a preselected power stroke time.

In the shifted arrangement of the control valve, port 27 of cylinder 23 is connected to supply conduit **15*a* and port 25 is connected to return conduit 15*b* to now decelerate the power element to a complete stop at the end of the stroke and initiate a return movement of the power element from the outermost power stroke-end disposition of FIG. 3 back to the innermost, retraction-end disposition of FIG. 2. More specifically, in the arrangement of FIG. 3, pressurized fluid is delivered from supply line 15*a* through conduit 48, port 34, upper annular flow passage 43, port 35 and conduit 26 to port 27. Port 25 is relieved through conduit 24, port 37, lower annular flow passage 44, port 36 and conduit 51 to return conduit 15*b*. The application of high pressure to the lower end of piston 20 and low pressure to the upper end of piston 19 effects an inward movement of the power element 16 so as to once again momentarily unblock port 28, and correspondingly once again provide communication from port 40 of the control valve 17 to the return conduit 15*b* to immediately throw spool 33 to the position of FIG. 2**, thereby initiating a subsequent power stroke.

As discussed above, the application of reverse hydraulic pressure to the pistons, while the tamper is moving to the forward end of its impact stroke as the result of the momentum and inertia forces, provides a tapping type impact force transfer to the work, resulting in improved efficiency and ease of operation of the tool.

To permit adjustment of the preselected power stroke of the tool, valve 18 provides an adjustable bypass from the supply conduit **15*a* to port 40, effectively changing the rate at which the pressure is equalized across valve port 46 when port 28 is closed. Thus, the rate of movement of spool 33 from the position of FIG. 2 to the position of FIG. 3 may be varied by suitable manual adjustment of valve 18 to provide an adjusted preselected time of the forward stroke. As will be obvious to those skilled in the art, a maximum power stroke period may be effected by closing the valve 18, or by eliminating the connection from port 38 to port 40**.

In the illustrated embodiment, the control valve 17 is shown as extending generally vertically within the relatively small diameter handle portion of the damper. As will be obvious to those skilled in the art, the valve may be of relatively small size so as to permit installation in any desired direction within the handle.

As will be obvious to those skilled in the art, the improved impact tool may more specifically be advantageously used in applications other than tamping, such as concrete breaking, earth digging, hammering, etc.

The impact tool is extremely simple and economical of construction and provides long trouble-free life while permitting facilitated use.

The foregoing disclosure of specific embodiments is illustrative of the broad inventive concepts comprehended by the invention.

I claim:

1. A reciprocating tool for applying a force to a yieldable work, said tool comprising: a support, a work engaging means carried by said support for reciprocation in forward and reverse directions relative to said support; forward force applying means carried by said support and cooperatively associated with said work engaging means for applying a forward force to said work engaging means to drive the work engaging means in said forward direction for a preselected time; reverse force applying means carried by said support and cooperatively associated with said work engaging means for applying a reverse force to the work engaging means at the end of said preselected time irrespective of the position of said work engaging means at that time to drive the work engaging means reversely back toward a preselected retracted position, said reverse force applying means including means for decelerating the work engaging means to zero forward speed in the event the work engaging means is continuing to move forwardly against the work at the end of said preselected time; and forward force reapplying means carried by said support and acting on said work engaging means for reapplying the forward force to the work engaging means to decelerate the reversely moving work engaging means to zero rearward speed at said retracted position and initiate a subsequent forward movement cycle as set forth above to effect controlled succession of force applications by said work engaging means against the work.

2. The reciprocating tool of claim 1 further including means for selectively adjusting said forward force applying means to cause said preselected time to be any one of a plurality of times.

3. The reciprocating tool of claim 1 wherein said force applying and reapplying means include a common source of pressurized fluid and a control valve for selectively controlling use of said pressurized fluid to drive and decelerate said work engaging means.

4. The reciprocating tool of claim 1 including a housing having a manual grasping portion, said force applying and reapplying means including a common source of pressurized fluid and a control valve within said housing for selectively controlling use of said pressurized fluid to drive and decelerate said work engaging means.

5. The reciprocating tool of claim 1 wherein said work engaging means comprises a tamping element.

6. The reciprocating tool of claim 1 wherein said forward force reapplying means includes fluid power means arranged to absorb inertia force generated by the movement of said work engaging means.

7. In a hydraulic impact tool for use with a hydraulic fluid power supply, said tool comprising: a reciprocative fluid motor; a work engaging member connected for reciprocation in a forward direction and a reverse direction by said fluid motor; and control means connected to said fluid motor for controlling fluid delivery from the hydraulic fluid power supply to said fluid motor for driving said work engaging member forwardly against the work, said control means including a timing means for causing said driving of the work engaging member for a preselected time irrespective of the position of the work engaging member subsequent to initiation of the forward driving of said work engaging member, and said control means subsequently after said preselected time driving said work engaging member away from the work to a preselected retracted position.

8. The hydraulic impact tool of claim 7 wherein means are provided for selectively adjusting said preselected time.

9. The hydraulic impact tool of claim 7 wherein said fluid motor comprises a housing and a piston hydraulically movable in said housing.

10. A hydraulic tamper for use with a hydraulic fluid power supply, said tamper comprising: a housing; a power element in said housing including a first, inner piston, a second, outer piston disposed outwardly of said first piston, and means connecting said pistons in longitudinal inner and outer spaced relationship in said housing; a tamping member disposed externally of said housing; means connecting said tamping member to said second piston in said housing; and control means in said housing for controlling fluid delivery from the hydraulic fluid power supply to said housing for reciprocating said power element inwardly and outwardly, said control means including means for seriatim (a) delivering hydraulic fluid for a preselected time from the power supply into said housing inwardly of said first piston and concurrently returning hydraulic fluid to the power supply from said housing between said pistons and from said housing outwardly of said second piston to urge said power element outwardly for a preselected time irrespective of the position of said power element during such outward movement, and (b) at the end of said preselected time delivering hydraulic fluid from the power supply into said housing outwardly of said second piston and concurrently returning hydraulic fluid from said housing inwardly of said first piston to move said power element to a preselected inner retracted position.

11. The hydraulic tamper of claim 10 wherein said control means includes a control valve controlling the hydraulic fluid delivery and return, and means for selectively controlling said valve as a function of the position of said power element in the housing.

12. The hydraulic tamper of claim 10 wherein said control means includes a control valve controlling the hydraulic fluid delivery and return, and means for selectively controlling said valve as a function of the position of said first piston in the housing.

13. A hydraulic tamper for use with a hydraulic fluid power supply, said tamper comprising: a housing; a power element in said housing including a first, inner piston, a second, outer piston disposed outwardly of said first piston, and means connecting said pistons in longitudinal inner and outer spaced relationship in said housing; a tamping member disposed externally of said housing; means connecting said tamping member to said second piston in said housing; and control means in said housing for controlling fluid delivery from the hydraulic fluid power supply to said housing for reciprocating said power element inwardly and outwardly, said control means including means for seriatim (a) delivering hydraulic fluid for a preselected time from the power supply into said housing inwardly of said first piston and concurrently returning hydraulic fluid to the power supply from said housing between said pistons and from said housing outwardly of said second piston to urge said power element outwardly for a preselected time, and (b) at the end of said preselected time delivering hydraulic fluid from the power supply into said housing outwardly of said second piston and concurrently returning hydraulic fluid from said housing inwardly of said first piston to move said power element to a preselected inner retracted position, said control means including a control valve controlling the hydraulic fluid delivery and return, means including biasing means for causing said valve to deliver hydraulic fluid for a preselected time from the fluid power supply into said housing inwardly of said first piston and concurrently returning hydraulic fluid to the fluid power supply from said housing between said pistons and from said housing outwardly of said second piston to urge said power element outwardly, and restricted fluid flow control means for overcoming the biasing of the valve and thereby causing delivery of hydraulic fluid from the power supply into said housing outwardly of said second piston and concurrently returning hydraulic fluid from said housing between said pistons and from said housing inwardly of said first piston to move said power element to a preselected inner retracted position.

14. The hydraulic tamper of claim 10 wherein said housing includes a control port closed by said first piston when the first piston is disposed outwardly and control valve means for controlling the hydraulic fluid delivery and return selectively positionable as an incident of the closing of said port by said first piston.

15. The hydraulic tamper of claim 10 wherein said control includes a control valve controlling the hydraulic fluid delivery and return, said housing includes a control port closed by said first piston when the first piston is disposed outwardly, and means for selectively positioning said control valve as a function of the opening and closing of said port.

16. The hydraulic tamper of claim 10 including means defining a control port closed as an incident of said first piston being disposed outwardly, and control valve means for controlling the hydraulic fluid delivery and return selectively positionable as an incident of the closing of said port.

17. The hydraulic tamper of claim 10 wherein said control includes a control valve controlling the hydraulic fluid delivery and return, and means for selectively positioning said valve as a function of the position of said power element in the housing.

18. A hydraulic tamper for use with a hydraulic fluid power supply, said tamper comprising: a housing; a power element in said housing including a first, inner piston, a second, outer piston, and means connecting said pistons in spaced relationship in said housing; a tamping member connected to said power element; and control means controlling fluid delivery from the hydraulic fluid power supply to said housing for reciprocating said power element, said control means connected to said power element defining means for seriatim (a) delivering hydraulic fluid for a preselected time from the power supply into said housing inwardly of said first piston and concurrently returning hydraulic fluid to the power supply from said housing between said pistons and from said housing outwardly of said second piston to urge said power element outwardly for a preselected time irrespective of the position of said power element during such outward movement, and (b) delivering hydraulic fluid from the power supply into said housing outwardly of said second piston and concurrently returning hydraulic fluid from said housing between said pistons and from said housing inwardly of said first piston to move said power element to a preselected inner retracted position, said control including a control valve controlling the hydraulic fluid delivery and return, means for selectively positioning said control valve as a function of the position of said power element in the housing, and adjustable valve means for regulating the control valve to vary the rate of movement of the control valve.

19. The hydraulic tamper of claim 10 including means defining a control port, said control port being closed as an incident of said first piston being disposed in an outer portion covering said port, and control valve means for controlling the hydraulic fluid delivery and return selectively positionable as an incident of the closing of said port, said first piston having an outer end, said power element having sufficient inertia to move said outer end of said first piston to substantially outwardly beyond said control port in an outermost disposition thereof.

20. A hydraulic tamper for use with a hydraulic fluid power supply, said tamper comprising: a housing; a piston means movable in said housing; a tamping member mounted to said piston means; and control means for controlling fluid delivery from the hydraulic fluid power supply into said housing to reciprocate said piston means and tamping member alternately in a forward tamping direction and a rearward retracting direction, said control means including means for causing application by the hydraulic fluid to the piston means of a forward tamping force for a preselected period of time irrespective of the position of said piston means during application of said forward tamping force and a subsequent reverse force acting concurrently with the absorption of tamping energy of said tamping member by the material being tamped to stop the forward tamping movement of the tamping member in the event the movement of the tamping member has not been stopped by the material at the end of said preselected period of time.

21. The hydraulic tamper of claim 20 wherein said control includes said tamping member to tap the material being tamped and allow the amount of compaction to be a function of the compactibility of the material and inertia of the moving elements of the tamper.

22. The hydraulic tamper of claim 20 wherein said control includes a control valve arranged to reverse the application of retracting forces by the hydraulic fluid at an outer preselected disposition of the power element.

* * * * *